US009037303B2

(12) United States Patent
Leise et al.

(10) Patent No.: US 9,037,303 B2
(45) Date of Patent: May 19, 2015

(54) HVAC CONTROLS OR CONTROLLERS INCLUDING ALPHANUMERIC DISPLAYS AND PUSH BUTTONS

(75) Inventors: William C. Leise, St. Louis, MO (US); John F. Broker, Warrenton, MO (US); Horst E. Jaeschke, Imperial, MO (US); Thomas B. Lorenz, St. Louis, MO (US); Harshal M. Pawar, Pune (IN)

(73) Assignee: Emerson Electric Co., St. Louis, MO (US)

( * ) Notice: Subject to any disclaimer, the term of this patent is extended or adjusted under 35 U.S.C. 154(b) by 483 days.

(21) Appl. No.: 13/535,396

(22) Filed: Jun. 28, 2012

(65) Prior Publication Data

US 2013/0345881 A1 Dec. 26, 2013

(30) Foreign Application Priority Data

Jun. 20, 2012 (IN) ..... 1772/MUM/2012

(51) Int. Cl.
*F24F 1/00* (2011.01)

(52) U.S. Cl.
CPC ..... *F24F 1/00* (2013.01)

(58) Field of Classification Search
CPC ..... Y02E 60/06; G05D 23/00; F24F 1/00; F24F 2221/00
USPC ..... 700/276–78, 299–300; 165/10, 58–59, 165/200; 236/1 C, 1 R, 91 D, 91 R
See application file for complete search history.

(56) References Cited

U.S. PATENT DOCUMENTS

| | | | | |
|---|---|---|---|---|
| 6,951,306 | B2 | 10/2005 | DeLuca | |
| 7,020,543 | B1 | 3/2006 | Jaeschke et al. | |
| 7,152,806 | B1 | 12/2006 | Rosen | |
| 7,296,426 | B2 | 11/2007 | Butler et al. | |
| 7,614,567 | B2 | 11/2009 | Chapman, Jr. et al. | |
| 7,664,575 | B2 | 2/2010 | Boydstun et al. | |
| 7,784,291 | B2 | 8/2010 | Butler et al. | |
| 7,801,646 | B2 * | 9/2010 | Amundson et al. | 700/276 |
| 7,999,789 | B2 * | 8/2011 | Ha et al. | 345/156 |
| 8,195,313 | B1 * | 6/2012 | Fadell et al. | 700/83 |
| 8,219,249 | B2 * | 7/2012 | Harrod et al. | 700/276 |

(Continued)

FOREIGN PATENT DOCUMENTS

EP 1926075 B1 1/2013

OTHER PUBLICATIONS

"Multi-digit LED Seven Segment Display"; www.snowdragonledhk.com; © 2007-2013; 2 pgs.

(Continued)

*Primary Examiner* — Ramesh Patel
(74) *Attorney, Agent, or Firm* — Harness, Dickey & Pierce, P.L.C.

(57) ABSTRACT

Exemplary embodiments are disclosed of a control for an HVAC system. The control has an alphanumeric display, a plurality of two position switches (e.g., push buttons, etc.), and a processor. The processor receives a current user input through at least one of the two position switches and determines a response to the current user input. The determining is performed using one or more previously received user inputs, if any, via one or more of the two position switches. The processor implements the determined response by displaying a message on the alphanumeric display and/or changing an operational parameter of the HVAC system.

21 Claims, 5 Drawing Sheets

(56) References Cited

U.S. PATENT DOCUMENTS

| | | | | |
|---|---|---|---|---|
| 8,239,066 | B2 * | 8/2012 | Jennings et al. | 700/276 |
| 8,255,086 | B2 * | 8/2012 | Grohman | 700/276 |
| 8,442,693 | B2 * | 5/2013 | Mirza et al. | 700/276 |
| 8,689,572 | B2 * | 4/2014 | Evans et al. | 62/126 |
| 8,902,071 | B2 * | 12/2014 | Barton et al. | 340/589 |
| 2004/0217182 | A1 * | 11/2004 | St. Jean et al. | 237/2 A |
| 2004/0220777 | A1 | 11/2004 | St. Jean et al. | |
| 2004/0230402 | A1 | 11/2004 | St. Jean | |
| 2007/0012052 | A1 * | 1/2007 | Butler et al. | 62/181 |
| 2008/0073440 | A1 | 3/2008 | Butler et al. | |
| 2008/0120446 | A1 * | 5/2008 | Butler et al. | 710/63 |

OTHER PUBLICATIONS http://www.kehongled.com/English/Products/LEDDisplays.html; Accessed and printed Jun. 28, 2012.

http://kehongled.en.alibaba.com/productshowimg/265049411-210046929/16_segment_graphic_LED_Display.html; Accessed and printed Jun. 28, 2012.

* cited by examiner

HVAC CONTROLS OR CONTROLLERS INCLUDING ALPHANUMERIC DISPLAYS AND PUSH BUTTONS

CROSS-REFERENCE TO RELATED APPLICATION

This application claims the benefit and priority of India Application No. 1772/MUM/2012, filed Jun. 20, 2012. The entire disclosure of the above application is incorporated herein by reference.

FIELD

The present disclosure relates to controls or controllers for heating, ventilation, and air conditioning (HVAC) systems, which include alphanumeric displays and two position switches (e.g., push buttons, etc.) that may be used for selecting menu options, setting or adjusting operational parameters, recalling faults, etc.

BACKGROUND

This section provides background information related to the present disclosure which is not necessarily prior art.

The operational parameters of an HVAC appliance (e.g., furnace, aft conditioner, etc.) may be set by using an HVAC control or controller. To set the operational parameters, a contractor, installer, or original equipment manufacturer may need to change the settings of one or more DIP (dual inline package) switches on the control or controller.

SUMMARY

This section provides a general summary of the disclosure, and is not a comprehensive disclosure of its full scope or all of its features.

Exemplary embodiments are disclosed of controls for heating, ventilation, and/or air conditioning systems. In an exemplary embodiment, a control generally includes an alphanumeric display, a plurality of two position switches, and a processor. The processor is configured to receive a current user input through at least one of the two position switches and to determine a response to the current user input such as by using one or more previously received user inputs, if any, via one or more of the two position switches. The processor is also configured to implement the determined response, display a message on the alphanumeric display, and/or changing an operational parameter of the heating, ventilation, and/or air conditioning system.

In another exemplary embodiment of a control for a heating, ventilation, and/or air conditioning system, the control generally includes a plurality of multiple-segment light-emitting diode (LED) displays operable for displaying alphanumeric characters including fault codes. The control also includes a plurality of two position switches. The two position switches and multiple-segment LED displays are configured to be usable for setting one or more values of one or more operational parameters of the control and for recalling fault codes for display by the multiple-segment LED displays.

Exemplary embodiments are also disclosed of methods of controlling heating, ventilation, and/or air conditioning systems. In an exemplary embodiment, a method is performed by a processor of a control including an alphanumeric display, the control further including a plurality of two position switches. The method includes receiving a current user input through at least one of the two position switches and determining a response to the current user input. The determining is performed using one or more user inputs, if any, previously received through one or more of the two position switches. The method also includes implementing the determined response, displaying a message on the alphanumeric display, and/or changing an operational parameter of the heating, ventilation, and/or air conditioning system.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Figure 1:
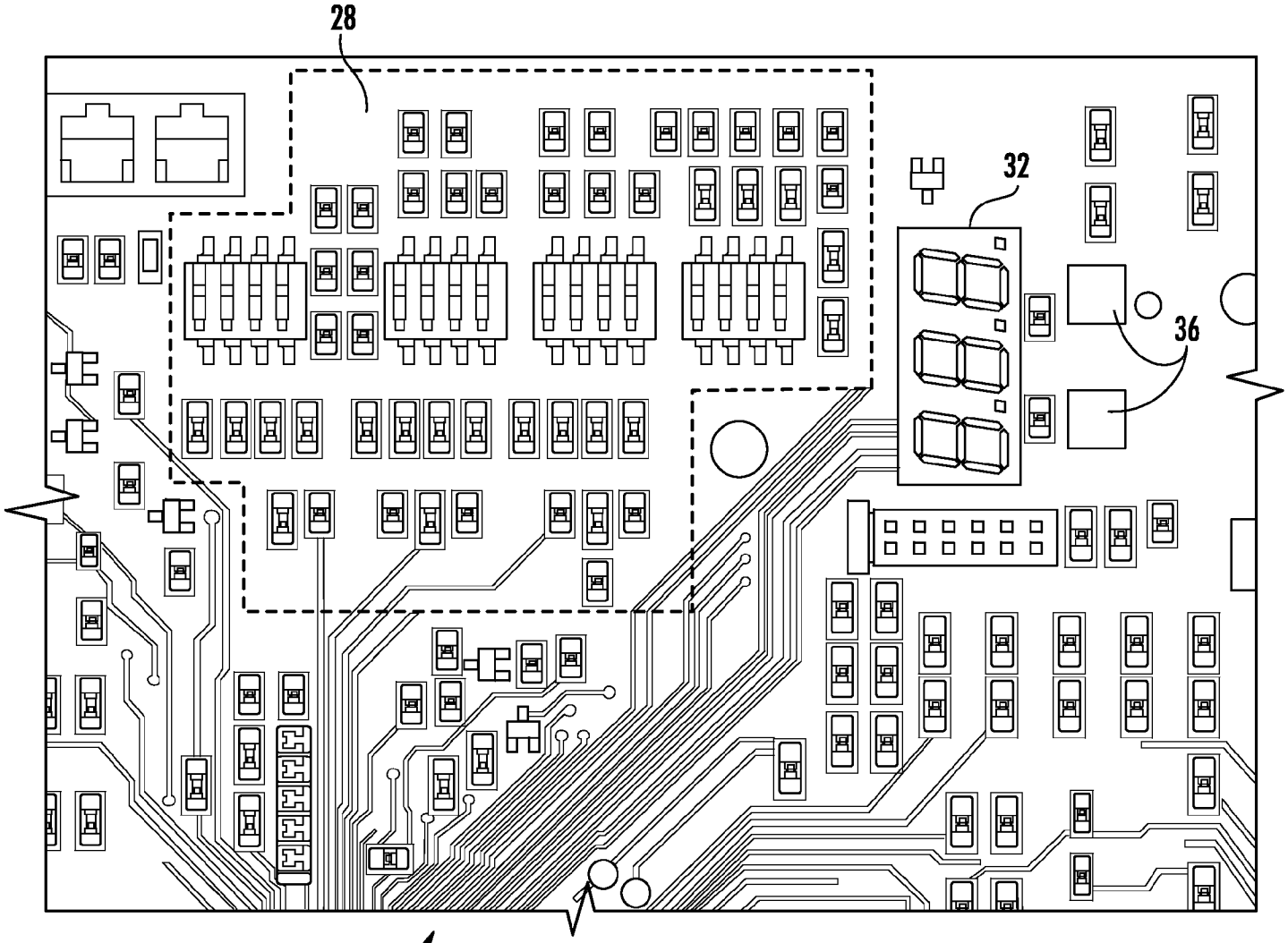
FIG. 1 is a simplified diagram of a portion of a printed circuit board (PCB) of an HVAC control or controller, the diagram showing DIP switches replaceable by an alphanumeric display and push buttons in accordance with an exemplary embodiment of the present disclosure.

Example embodiments will now be described more fully with reference to the accompanying drawings.

Disclosed herein are exemplary embodiments of controls for heating, ventilation, and/or air conditioning (HVAC) systems. In various aspects, a control includes an alphanumeric display configuration having a plurality of multiple-segment displays, e.g., three seven-segment displays, three sixteen-segment displays, etc. The control also includes a plurality of two position switches, such as push buttons, two position slide switch, dip switches, momentary switches, etc. The control further includes a processor configured to receive a current user input through at least one of the two position switches. The processor determines a response to the current user input. To make such a determination, the processor may use one or more previously received user inputs, if any, via one or more of the two position switches.

For example, in exemplary embodiments in which the two position switches are push buttons, the processor may use a sequence of signals from the push buttons, determine a length of time over which a signal is received from one of the push buttons, and/or determine a number of times a signal is received from one of the push buttons. To implement the determined response, the processor may display a message on the display configuration and/or change an operational parameter of the HVAC system. For example, at least one previous fault in the HVAC system may be displayed. Additionally or alternatively, the processor may change various operating parameters, including, but not limited to, a cooling off delay, outdoor tonnage, cubic feet per minute (CFM) per ton, heat off delay, inter-stage delay, and/or gas heating CFM.

Exemplary embodiments are disclosed herein of control boards for controllers or controls, which may be used with furnace controls (e.g., integrated furnace control (IFC), etc.), air handler controls, unitary controls, among other possible controls or controllers for residential HVAC or commercial HVAC. In an exemplary embodiment, a control includes an alphanumeric display configuration having a plurality of multiple-segment displays (e.g., light-emitting diode (LED) seven-segment displays, LED sixteen-segment displays, etc.) and a keypad with push buttons (e.g., two or more momentary push buttons, etc.) for setting operational parameters, recalling fault codes, etc. In this exemplary embodiment, the push buttons are an exemplary type of two position switch where a default position is a spring return, and the other position requires the user to depress the button or switch to overcome the spring. Alternative embodiments may use other two position switches instead of, or in addition to push buttons, such as one or more of a two position slide switch, dip switch, etc.

In operation, the LED display and keypad may be used for selecting a menu and then setting or adjusting an operational parameter for the selected menu. As another example, the LED display and keypad may be used for recalling a fault. As a further example, a control's delays may be set using the LED display and keypad.

With reference now to the figures, FIG. 1 illustrates a portion of a control printed circuit board (PCB) 20 including a DIP switch configuration 28 (shown in dashed lines). DIP switch configurations, which occupy considerable space on PCBs, are commonly used on conventional PCBs for HVAC controls. In various aspects of the present disclosure, the large number of DIP switches may be replaced, e.g., by an alphanumeric display and a plurality of two position switches (e.g., two push buttons, etc.) that can occupy considerably less space than a DIP switch configuration. An example alphanumeric display (e.g., a LED display configuration 32, etc.) and two example push buttons 36 are shown on the PCB 20 for the sake of comparison as to amounts of occupied board space.

Figure 2:
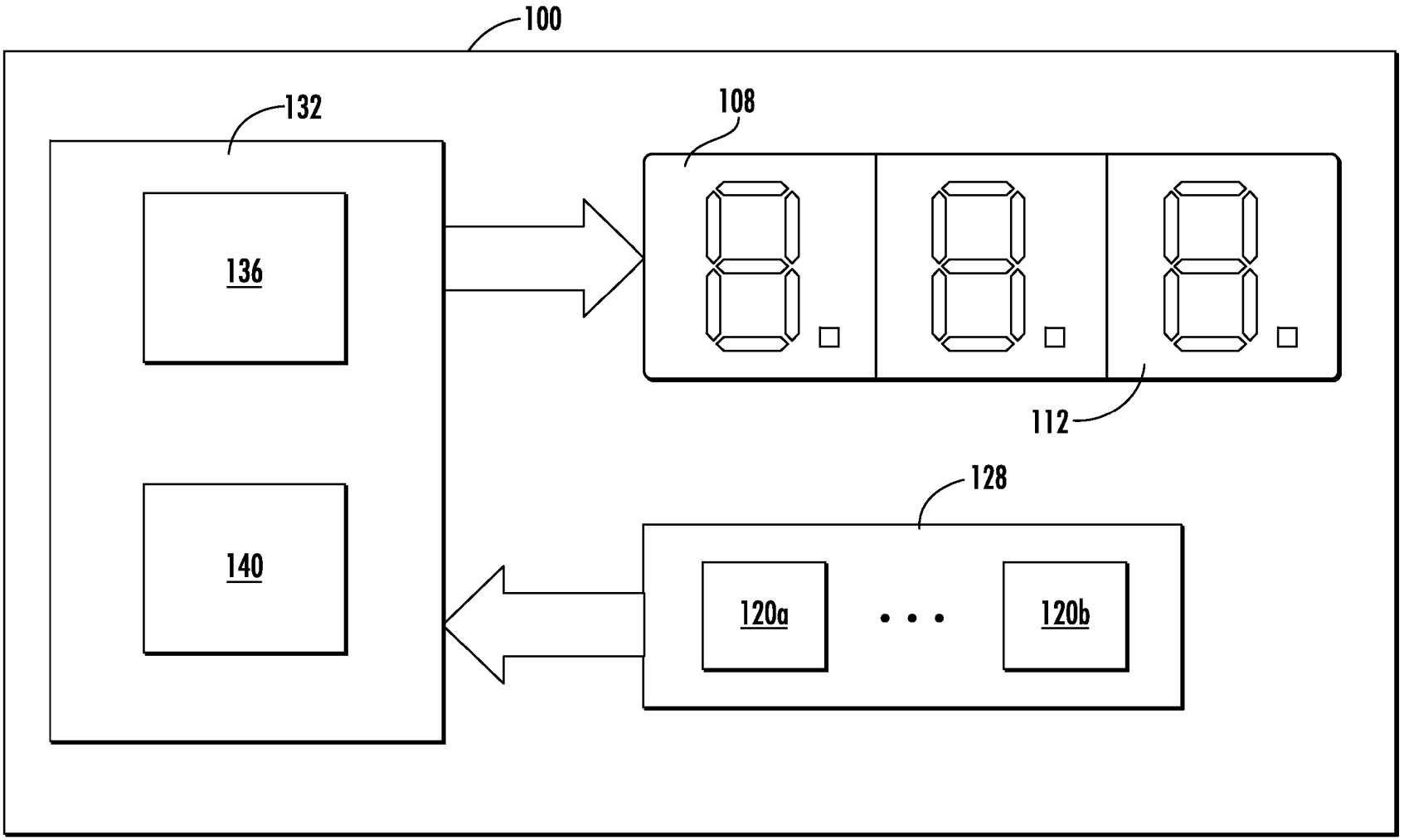
FIG. 2 is a block diagram of an exemplary embodiment of a control or controller including a microprocessor or microcontroller coupled with a key pad and an alphanumeric display for setting operational parameters using the keypad.

FIG. 2 is a diagram of an example control 100 for a heating, ventilation, and/or air conditioning system. The control 100 includes an alphanumeric display 108. In the present example embodiment, the alphanumeric display 108 includes three (3) light-emitting diode (LED) seven-segment displays 112. In various aspects, an alphanumeric display may include one or more dot matrix displays, one or more multiple-segment displays having more than or fewer than seven segments, etc. For example, another exemplary embodiment includes an alphanumeric display having three (3) light-emitting diode (LED) sixteen-segment displays.

The control 100 also has a plurality of keys or push buttons, e.g., momentary push buttons 120*a* and 120*b* provided on a keypad 128. Although two push buttons (120*a*, 120*b*) are shown in FIG. 2, more than two push buttons may be provided in alternative embodiments. In addition, alternative embodiments may use other two position switches instead of, or in addition to push buttons, such as one or more of a two position slide switch, dip switch, etc. For example, another exemplary embodiment includes two position slide switches and an alphanumeric display having a plurality of light-emitting diode (LED) seven-segment and/or sixteen-segment displays.

A microcontroller 132 includes a processor 136 configured to receive a current user input through at least one of the push buttons (120*a*, 120*b*) and to determine how to respond to the current user input. To determine a response, the processor 136 may use one or more user inputs, if any, previously received via the push button(s) (120*a*, 120*b*). To implement the determined response, the processor 136 may, e.g., display a message on the alphanumeric display 108 and/or change an operational parameter of the HVAC system. The microcontroller 132 also includes memory 140 in which, e.g., operational parameters may be stored and changed in response to user input via the push buttons (120*a*, 120*b*).

Figure 3:
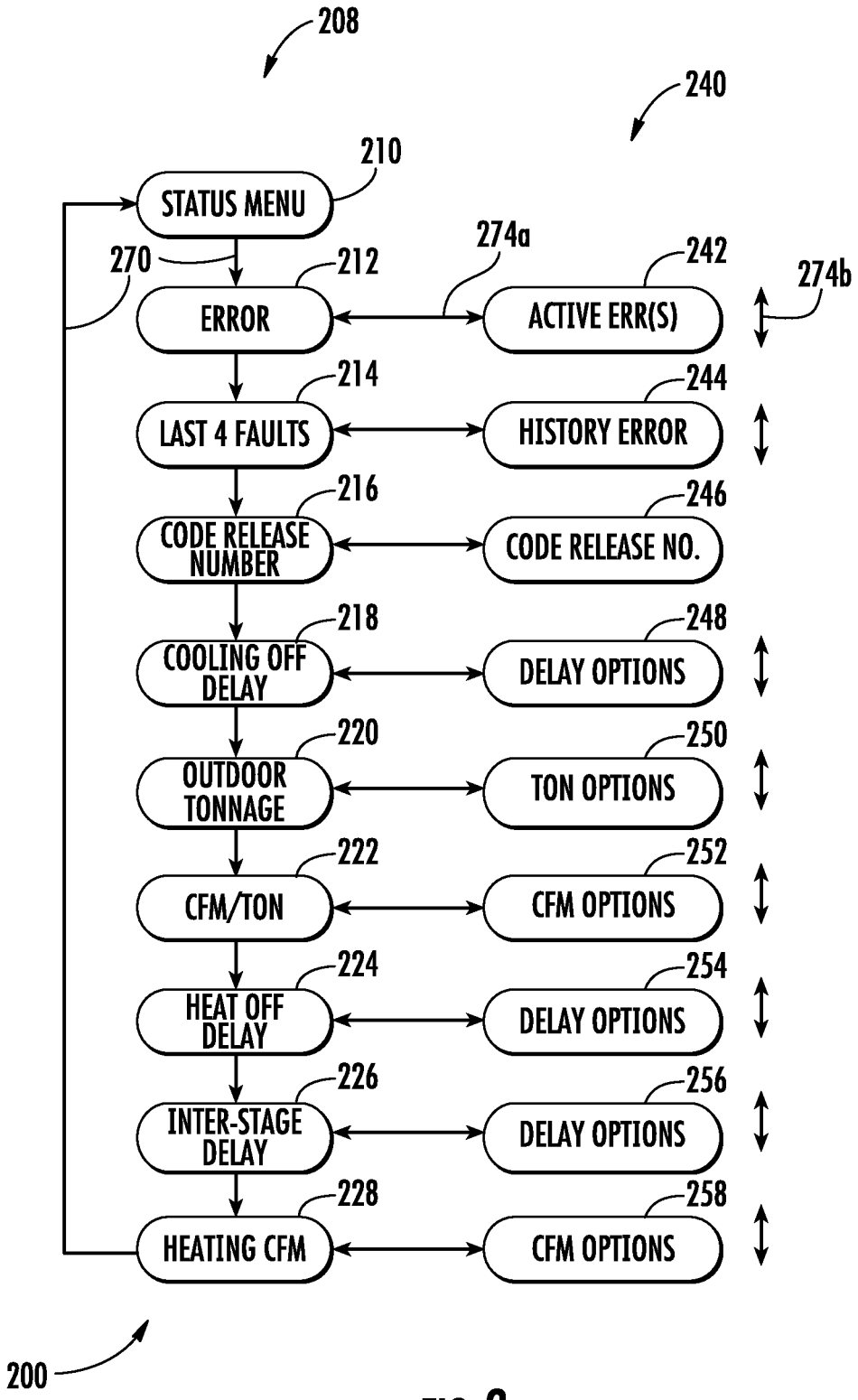
FIG. 3 is a diagram of an exemplary embodiment of a human-machine interface (HMI) menu structure for an HVAC control.

FIG. 3 is a diagram of an example human-machine interface (HMI) menu structure 200, e.g., for the control 100. The menu structure 200 includes a plurality of menus 208, e.g., a Status menu 210, an Error menu 212, a Last Four Faults menu 214, a Code Release Number menu 216, a Cooling Off Delay menu 218, an Outdoor Tonnage menu 220, a CFM/Ton menu 222, a Heat Off Delay menu 224, an Inter-Stage Delay menu 226, and a Heating CFM menu 228.

With the exception of the Status menu 210 as further described below, each menu 208 provides one or more menu options 240. In the present example HMI menu structure 200, the Error menu 212 provides Active Error(s) 242, the Last Four Faults menu 214 provides History Error(s) 244, the Code Release Number menu 216 provides a Code Release Number 246, the Cooling Off Delay menu 218 provides Cooling Off Delay Options 248, the Outdoor Tonnage menu 220 provides Ton Options 250, the CFM/Ton menu 222 provides CFM Options 252, the Heat Off Delay menu 224 provides Heat Off Delay Options 254, the Inter-Stage Delay menu 226 provides Inter-Stage Delay Options 256, and the Heating CFM menu 228 provides Heating CFM Options 258.

In the present example embodiment, and referring to FIG. 2, the two push buttons (120*a*, 120*b*) may be used to navigate the menu structure 200. One push button, e.g., the button 120*a* (a "menu key") may be used, e.g., to browse the menus 208, and the other push button 120*b* (an "option key") may be used, e.g., to browse the menu options 240. When the menu key 120*a* is pressed, the alphanumeric display 108 may show the next available menu 208, e.g., in a sequence and cycle indicated by arrows 270 in FIG. 3. When a user has activated a menu 208, he or she may press the option key 120*b* to navigate to and scroll through available menu option(s) 240, e.g., as indicated by arrows 274*a* and 274*b* in FIG. 3.

Status Menu

In the present example embodiment, activating the Status menu 210 causes a current operation mode of the HVAC system to be displayed in the alphanumeric display 108. Example operation modes and example corresponding display codes for an HVAC system are listed in Table 1. Of course, in general, various codes, abbreviations, fonts, etc. could be used in various aspects of the disclosure, depending on (among other things) the structure of an alphanumeric display used in a given embodiment. For example, where a seven-segment display is used, a font conforming to the seven-segment structure would be used in the display. In the tables and examples herein, fonts have been used (for the purpose of clarity of explanation) that would not necessarily conform to the structure of a given display.

TABLE 1

| HMI Mode Display | | | |
|---|---|---|---|
| Mode | Display #3 | Display #2 | Display #1 |
| Idle | I | D | L |
| Continuous Fan | C | O | F |
| Cooling | C | O | L |
| Mechanical Heat | | H | P |
| Gas Heat | G | H | T |

Figure 4:
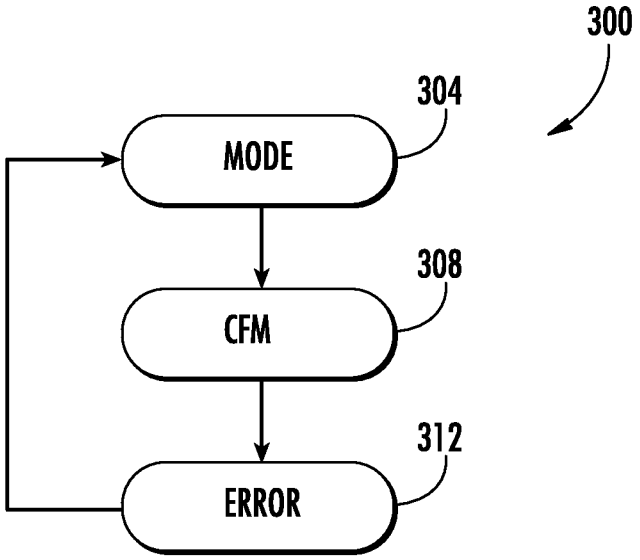
FIG. 4 is a diagram of an exemplary embodiment of a status display sequence for an HVAC control.

The display of a current operating mode may or may not be followed by a display of additional information. For example, FIG. 4 illustrates an exemplary embodiment of a status display sequence 300. As shown in FIG. 4, if a blower of the HVAC system is running, a display 304 of the current operating mode is replaced after, e.g., a one-second delay, by a display 308 of the blower CFM, e.g., as a code beginning with "A" and followed by a two-digit number representing actual CFM to the blower divided by 100, rounded down to an integer. If an alarm is detected in the HVAC system, the display 308 of the blower CFM (or the display 304 of the current operating mode, if the blower is not running) is replaced after, e.g., one second by a display 312 of an alarm error code. An error code is displayed in the alphanumeric display 108, e.g., as a code beginning with "E" and followed by a two-digit error code. If more than one alarm is active, then the alarm with the highest priority, or the latest alarm of equal-priority active alarms, may be displayed. Thus, for example, when more than one status is active, the active statuses may be displayed in a rotation in which an active status is displayed for one second, the alphanumeric display 108 is switched off for one second, the next active status is then displayed for one second, etc.

Example display codes for menus 208 and their corresponding menu options 240 are listed in Table 2.

TABLE 2

| HMI Display Codes | | | | | | |
|---|---|---|---|---|---|---|
| | Menu | | | Menu Options | | |
| | Display 3 | Display 2 | Display 1 | Display 3 | Display 2 | Display 1 |
| Status Menu | | | | | N/A | |
| Error Menu | E | R | R | E | alarm code(s) | |
| Last 4 Faults | L | 4 | F | E | | |
| Code Release Number | | C | R | | CR Number | |
| Cooling Off | C | O | D | | Delay, Seconds | |
| Delay | | | | | Delay, Seconds | |
| | | | | | Delay, Seconds | |
| | | | | | E | H |
| Outdoor | O | D | T | | Actual Tonnage | |
| Tonnage | | | | | Actual Tonnage | |
| | | | | | Actual Tonnage | |
| | | | | | Actual Tonnage | |
| CFM/Ton | C | P | T | | Actual CFM/Ton | |
| | | | | | Actual CFM/Ton | |
| | | | | | Actual CFM/Ton | |
| Heat Off | H | O | D | | Delay, Seconds | |
| Delay | | | | | Delay, Seconds | |
| | | | | | Delay, Seconds | |
| | | | | | Delay, Seconds | |
| Inter-Stage | I | S | D | | Delay, Seconds | |
| Delay | | | | | Delay, Seconds | |
| | | | | | Delay, Seconds | |
| | | | | | Delay, Seconds | |
| Gas | G | H | C | | Actual CFM/10 | |
| Heating | | | | | Actual CFM/10 | |
| CFM | | | | | Actual CFM/10 | |
| | | | | | Actual CFM/10 | |

Error Menu

Referring again to FIG. 3, to navigate from the Status menu 210 to the Error menu 212, the user may press the menu key 120*a* once. The user then presses the option key 120*b* to browse all active alarm(s) in the Active Error(s) 242. If no alarm is active, the alphanumeric display 108 shows "E", "0" and "0." In the present embodiment, as many as four active alarms may be included in the Active Error(s) 242, although in other embodiments, more or fewer active alarms may be shown. When an alarm is active, it is also included in the History Error(s) 244 for the Last Four Faults menu 214.

Last Four Faults Menu

To navigate from the Error menu 212 to the Last Four Faults menu 214, the user may press the menu key 120*a* once. The user then presses the option key 120*b* to browse the last four faults in the History Error(s) 244. If no alarm is in the History Error(s) 244, the alphanumeric display 108 shows "E", "0" and "0". In the present embodiment, as many as four history alarms may be included in the History Error(s) 244, although in other embodiments, more than or fewer than four history alarms may be shown. To clear all alarms from the History Error(s) 244, the user may, e.g., press the option key 120*b* for five (5) seconds. The alphanumeric display 108 may signal, e.g., "E", "0" and "0" intermittently, e.g., ¼ second on and ¾ second off, to indicate that the alarm(s) are successfully removed. The alphanumeric display 108 then may return to the Last Four Faults menu 214.

Code Release Number Menu

To navigate from the Last Four Faults menu 214 to the Code Release Number menu 216, the user may press the menu key 120*a* once. The user then presses the option key 210*b* to review the code release number for firmware of the HVAC system.

Cooling Off Delay Menu

To navigate from the Code Release Number menu 216 to the Cooling Off Delay menu 218, the user may press the menu key 120*a* once. The user then presses the option key 120*b* to browse Cooling Off Delay Options 248. In the present example embodiment, as many as four delay options may be made available in the Cooling Off Delay Options 248, although in other embodiments, more than or fewer than four delay options may be made available. In the present example embodiment and as shown in Table 2, three of the Cooling Off Delay Options 248 are displayed and selectable as numbers of seconds of delay. A fourth option, enhanced mode, may be displayed, e.g., as an "E" together with an "H."

Outdoor Tonnage, CFM/TON, Heat Off Delay, Inter-Stage Delay, Heating CFM Menus

The menus 220, 222, 224, 226, and 228 and their corresponding menu options 250, 252, 254, 256, and 258 may be reached in the same or similar manner as previously discussed. In the present example embodiment and as shown in Table 2, Ton Options 250 may be displayed and selectable as numbers of actual tonnage. CFM Options 252 may be displayed and selectable as numbers of actual CFM per ton. Heat Off Delay Options 254 and Inter-Stage Delay Options 256 may be displayed and selectable as numbers of seconds of delay. Heating CFM Options 258 may be displayed and selectable as numbers of actual CFM divided by 10.

If, e.g., the control 100 is in normal operation, a user-selected option becomes effective on the next valid call for heat or cooling. Generally, in various embodiments when a user browses menu options 240, a default option, or an option previously selected and currently in effect in the HVAC system, may be displayed first. Any additional available options for the corresponding menu 208 may be subsequently displayed in response to user input, e.g., via the option key 120*b*.

It should be noted that other or additional menus, options and/or operating parameters and conditions could be included for display and/or selection in various embodiments. In various HVAC control embodiments, an option may be made available and selectable by a user's entry of a user-selected number or other character. For example, the user may hold down a momentary option key for a length of time corresponding to a digit or other character to enter that digit or character as an option value (or as part of an option value having more than one digit or character). In such exemplary manner, the user is not limited to preset options but may enter a different option value. In various embodiments, such user-entered option values may be displayed in an alphanumeric display and used by the control, e.g., to change an operating parameter of the HVAC system.

Referring again to FIGS. 2 and 3, at HVAC system power-up, a pre-designated signal may be displayed on the alphanumeric display 108 for a pre-designated time period, after which the Status menu 210 is displayed. Generally, while any menu 208 other than the Status menu 210 is displayed, if no signal from the push buttons 120*a*, 120*b* is received for a predetermined time period, e.g., 30 seconds, the control 100 may return to display the Status menu 210 automatically, without selecting any currently-displayed option.

Figure 5:
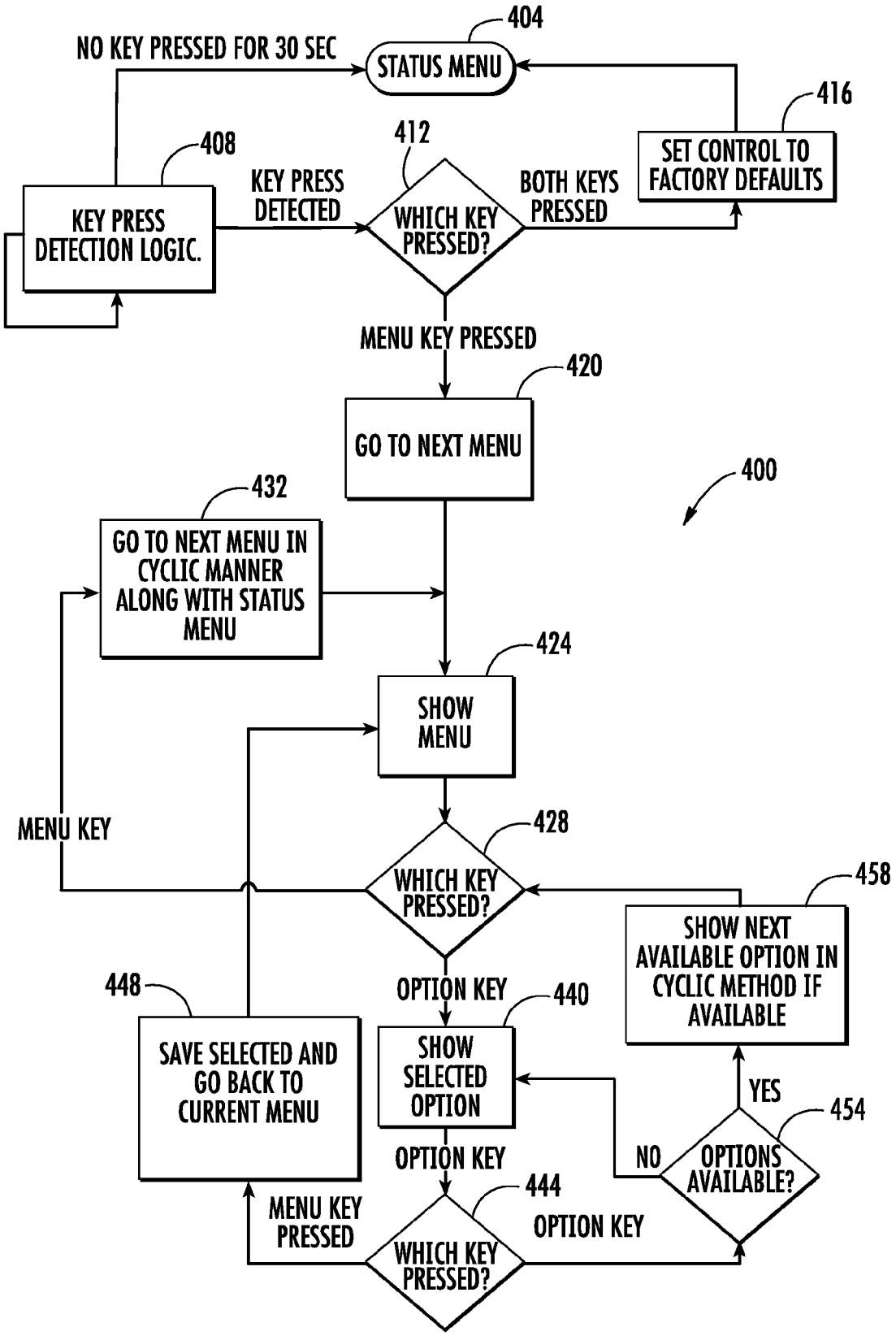
FIG. 5 is a flowchart illustrating an exemplary operational sequence for selecting a menu and then setting or adjusting an operational parameter for the selected menu using the control shown in FIG. 2 in accordance with an exemplary embodiment of the present disclosure.

A control may be used for controlling operation of an HVAC system in accordance with one example method indicated generally in FIG. 5 by reference number 400. The method 400 shall be described with reference to the control 100 and the menu structure 200. In process 404, the Status menu 210 is displayed, e.g., until in process 408 a key is detected as having been pressed. In process 412, it is determined which key was pressed. If both the menu key 120*a* and the option key 120*b* were pressed, e.g., pressed simultaneously for more than 10 seconds, then in process 416 the control 100 resets system options to factory default values, flashes a pre-designated signal on the alphanumeric display 108 to indicate a successful reset, and returns to the Status menu 210 in process 404.

If in process 412 it is determined that the menu key 120*a* was pressed, then in process 420 the control 100 proceeds to the next menu 208, which is displayed in process 424. In process 428, it is determined (a) that a key was pressed and (b) which key was pressed. If the menu key 120*a* was pressed, then in process 432, the control 100 proceeds to the next menu 208, e.g., in the pre-designated cycle shown in FIG. 3 (which cycle may resume with the Status menu 210, if the menu key 120*a* was pressed while the Heating CFM menu 228 was displayed).

If in process 428 the option key 120*b* was pressed, then in process 440 a menu option 240 associated with the menu 208 previously shown in process 424 is displayed. In process 444, it is determined (a) that a key was pressed and (b) which key was pressed. If the menu key 120*a* was pressed, then the user has selected the displayed menu option 240. Accordingly in process 448, the control 100 saves the user selection, which may be e.g., a change to an HVAC system parameter, and returns to repeat the display of the associated menu 208 in process 424. If the option key 120*b* was pressed in process 444, it is determined in process 454 whether the current menu 208 makes more than one menu option 240 available. If yes, then in process 458 the next available menu option 240 is displayed. Processes 428, 440, 444, 454, and 458 may be repeated as the user cycles through the available menu options 240 before selecting one (by pressing the menu key 120*a*.) If no additional menu options 240 are available, then the last-displayed menu option 240 is displayed in process 440, until in process 444 it is determined that the user pressed the menu key 120*a*.

The method 400 is only one example of how a control may use an alphanumeric display and two position switches (e.g., push buttons, etc.) to display and present user options as to various system conditions, modes, and operating parameters. Other or additional selections and selection sequences may be provided for various types of systems.

In exemplary embodiments, the use of at least three seven-segment LED displays in conjunction with two momentary push buttons or other two position switches (e.g., two position slide switches, etc.) allow contractors, original equipment manufacturers (OEMs), etc. to establish the operational settings for the control and to use the same display for fault recall. This may be achieved, for example, by pressing one or more of the momentary push buttons to enter a menu. Or, for example, this may be achieved by sliding one or more of the slide switches to enter a menu. The menu may be a parameter setting menu, fault recall menu, or other.

With the LED displays and two position switches (e.g., push buttons, momentary or two position slide switches, etc.) exemplary embodiments of the controls or controllers disclosed herein may thus provide an improved display and user interface that is more user friendly and/or more appealing to end users (e.g., contractors, OEMs, etc.) as compared to some controls or controllers having a large number of DIP switches to set operational parameters and a single LED having a variety of blink rates to determine fault codes.

As recognized by the inventors hereof, it can be difficult to set a large number of DIP switches of an IFC to set the values for proper furnace operation. For example, the control's delays may have to be set externally using DIP switches and resistor networks. The DIP switches may also be restricted to be used for setting only limited parameters with a limited number of settings. It can also be hard to identify faults with historical codes correlated to the blinking of a single LED. Exemplary embodiments disclosed herein may use a plurality of momentary two position switches (e.g., push buttons, momentary or two position slide switches, etc.) and a multi-digit LED display (e.g., seven-segment and/or sixteen-segment LED displays, etc.) that may provide one or more of the following advantages, such as easier setup of the operational parameters, allowing features to be added to the control, easier parameter settings, reduced printed circuit board (PCB) space, added visual effect, cost savings, more allowed settings, etc. One or more "modes" can be entered, for example, by means of button presses or switch slides by time and/or sequence. Settings can be changed to improve or affect operation. Parameter values can be set to substantially any appropriate value rather than fixed discrete values. Codes from past operation can be viewed to help understand problems or to better diagnose problems. Data about operation can be viewed to make improvements.

Exemplary embodiments disclosed herein may be used with an Integrated Furnace Control (IFC), an air handler control, a unitary control for heating and/or cooling appliances, among other possible controls or controllers for residential or commercial HVAC appliances or systems. Accordingly, aspects of the present disclosure should not be limited to use with any one particular type of control or controller.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (the disclosure of a first value and a second value for a given parameter can be interpreted as disclosing that any value between the first and second values could also be employed for the given parameter). Similarly, it is envisioned that disclosure of two or more ranges of values for a parameter (whether such ranges are nested, overlapping or distinct) subsume all possible combination of ranges for the value that might be claimed using endpoints of the disclosed ranges.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A control for a heating, ventilation and/or air conditioning (HVAC) system appliance, the control comprising:

an alphanumeric display;

a plurality of two position switches; and a processor configured to:

receive a current user input through at least one of the two position switches;

determine a response to the current user input using one or more previously received user inputs, if any, via one or more of the two position switches, user inputs received through the two position switches being independent of receipt of any user input to a thermostat controller, if any; and implement the determined response, display a message on the alphanumeric display, and/or change an operational parameter of the HVAC system appliance.

2. The control of claim 1, wherein the alphanumeric display is operable for displaying at least one previous fault in the HVAC system appliance.

3. The control of claim 1, wherein the alphanumeric display comprises a multiple-segment display.

4. The control of claim 1, wherein the alphanumeric display comprises three seven-segment light-emitting diode (LED) displays.

5. The control of claim 1, wherein:

the plurality of two position switches comprises a plurality of push buttons; and the processor is configured to determine a response to the current user input by determining a length of time over which a signal is received from one of the push buttons, and/or by determining a number of times a signal is received from one of the push buttons.

6. The control of claim 1, wherein:

the plurality of two position switches comprises a menu key and an option key; and the processor is configured to determine a response to the current user input based on a sequence of signals from the menu key and option key.

7. The control of claim 1, wherein:

the alphanumeric display, push buttons, and processor are configured to be usable for changing one or more operational parameters of the heating, ventilation, and/or air conditioning system, including at least one or more of a cooling off delay, outdoor tonnage, cubic feet per minute (CFM) per ton, heat off delay, inter-stage delay, and/or gas heating CFM; and/or the control is configured such that the alphanumeric display is operable for displaying at least one or more of a current mode of the heating, ventilation, and/or air conditioning system, a currently active fault in the heating, ventilation, and/or air conditioning system, and/or a current cubic feet per minute (CFM) of a currently running blower of the heating, ventilation, and/or air conditioning system.

8. The control of claim 1, wherein the control is configured such that an operational parameter of the heating, ventilation, and/or air conditioning system is changeable in accordance with a menu option displayed on the alphanumeric display.

9. The control of claim 1, wherein the plurality of two position switches comprises a plurality of push buttons; and/or wherein the control is for one of the following appliances: a furnace, an air handler, an air conditioner, and a heat pump.

10. A control for a heating, ventilation, and/or air conditioning system appliance, the control comprising:

a plurality of multiple-segment light-emitting diode (LED) displays operable for displaying alphanumeric characters including fault codes for the appliance; and a plurality of two position switches for receiving user inputs independently of receipt of any user input to a thermostat controller, if any;

the two position switches and multiple-segment LED displays configured to be usable for setting one or more values of one or more operational parameters of the control and for recalling fault codes for display by the multiple-segment LED displays.

11. The control of claim 10, wherein:

the plurality of multiple-segment light-emitting diode (LED) displays comprises at least three seven-segment light-emitting diode (LED) displays; and/or the plurality of two position switches comprises at least two momentary push buttons.

12. The control of claim 10, wherein:

the plurality of two position switches comprises a plurality of momentary push buttons configured to allow user selection of a parameter setting mode or fault recall mode by pressing one or more of the momentary push buttons; and/or the control is configured such that an operational parameter of the heating, ventilation, and/or air conditioning system is changeable in accordance with a menu option displayed on the multiple-segment LED displays.

13. The control of claim 10, further comprising a processor configured to receive a current user input through at least one of the two position switches, the processor further configured to determine a response to the current user input, by using one or more previously received user inputs, if any, via one or more of the two position switches and to implement the determined response, display a message on the multiple-segment LED displays, and/or change an operational parameter of the heating, ventilation, and/or air conditioning system.

14. The control of claim 13, wherein:

the plurality of two position switches comprises a menu key and an option key; and the processor is configured to determine a response to the current user input based on a sequence of signals from the menu key and option key.

15. The control of claim 10, wherein:

the two position switches and multiple-segment LED displays are configured to be usable for changing one or more operational parameters of the heating, ventilation, and/or air conditioning system, including at least one or more of a cooling off delay, outdoor tonnage, cubic feet per minute (CFM) per ton, heat off delay, inter-stage delay, and/or gas heating CFM; and/or the control is configured such that the multiple-segment LED displays are operable for displaying at least one or more of a current mode of the heating, ventilation, and/or air conditioning system, a currently active fault in the heating, ventilation, and/or air conditioning system, and/or a current cubic feet per minute (CFM) of a currently running blower of the heating, ventilation, and/or air conditioning system.

16. A method of controlling a heating, ventilation, and/or air conditioning system appliance, the method performed by a processor of a control for the appliance, the control including an alphanumeric display and a plurality of two position switches, the method comprising:

receiving a current user input through at least one of the two position switches;

determining a response to the current user input, the determining performed using one or more user inputs, if any, previously received through one or more of the two position switches, user inputs received through the two position switches being independent of receipt of any user input to a thermostat controller, if any; and implementing the determined response, displaying a message on the alphanumeric display and/or changing an operational parameter of the heating, ventilation, and/or air conditioning system appliance.

17. The method of claim 16, wherein the method includes displaying a message on the alphanumeric display including at least one or more of:

at least one previous fault in the heating, ventilation, and/or air conditioning system;

a current mode of the heating, ventilation, and/or air conditioning system;

a currently active fault in the heating, ventilation, and/or air conditioning system; and/or a current cubic feet per minute (CFM) of a currently running blower of the heating, ventilation, and/or air conditioning system.

18. The method of claim 16, wherein the method includes changing an operational parameter of the heating, ventilation, and/or air conditioning system including at least one or more of a cooling off delay, outdoor tonnage, CFM per ton, heat off delay, inter-stage delay, and/or gas heating CFM.

19. The method of claim 16, wherein:

the alphanumeric display comprises a multiple-segment display; and/or the alphanumeric display comprises three seven-segment light-emitting diode (LED) displays.

20. The method of claim 16, wherein:

the plurality of two position switches comprises at least two push buttons; and determining a response to the current user input comprises:

determining a length of time over which a signal is received from one of the push buttons; and/or determining a number of times a signal is received from one of the push buttons.

21. The method of claim 16, wherein:

the plurality of two position switches comprises a menu key and an option key, and the method includes determining a response to the current user input based on a sequence of signals from the menu key and option key; and/or the method includes changing an operational parameter of the heating, ventilation, and/or air conditioning system in accordance with a menu option displayed on the alphanumeric display.

* * * * *